US012331525B2

(12) United States Patent
Lopez

(10) Patent No.: US 12,331,525 B2
(45) Date of Patent: Jun. 17, 2025

(54) DUAL-SIDED MOUNTING BRACKET

(71) Applicant: Hohmann & Barnard, Inc., Hauppauge, NY (US)

(72) Inventor: Robert Lopez, Queens, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 97 days.

(21) Appl. No.: 18/470,040

(22) Filed: Sep. 19, 2023

(65) Prior Publication Data

US 2024/0093505 A1 Mar. 21, 2024

Related U.S. Application Data

(60) Provisional application No. 63/408,635, filed on Sep. 21, 2022.

(51) Int. Cl.

| | |
|---|---|
| ***E04F 13/08*** | (2006.01) |
| ***E04B 1/38*** | (2006.01) |
| ***E04B 1/41*** | (2006.01) |

(52) U.S. Cl.

CPC ..... *E04F 13/0808* (2013.01); *E04B 1/388* (2023.08); *E04B 1/41* (2013.01); *E04B 2001/389* (2023.08); *E04B 2001/4192* (2013.01)

(58) Field of Classification Search

CPC ..... E04F 13/0808; E04B 1/388; E04B 1/41; E04B 2001/389; E04B 2001/4192

See application file for complete search history.

(56) References Cited

U.S. PATENT DOCUMENTS 3,490,797 A * 1/1970 Platte ..... F16B 5/07 403/231
3,972,168 A * 8/1976 Allen ..... E04B 1/4114 52/713
5,519,976 A * 5/1996 Gee ..... E04F 21/1838 52/715
5,720,571 A * 2/1998 Frobosilo ..... E04B 2/96 403/231

(Continued)

FOREIGN PATENT DOCUMENTS

WO 2018036756 A1 3/2018

OTHER PUBLICATIONS

Ash & Lacy "AxiAL Rainscreen Support Systems" ashandlacy.com, brochure, 17 pages, accessed Mar. 26, 2025.

(Continued)

*Primary Examiner* — Monica E Millner

(74) *Attorney, Agent, or Firm* — Andrus Intellectual Property Law, LLP

(57) ABSTRACT

A dual-sided mounting bracket for a facade support system includes an L-shaped member having a baseplate for securing to a wall structure and a leg extending from and transverse to the baseplate. The leg defines inside and outside surfaces and a plane. The leg has first and second clips formed therein on opposing sides of a height centerline and extending opposite directions from the leg plane. The clips each define an angled opening at free ends thereof and a capture region adjacent to the angled openings. The first and second clips are configured to receive the support member in either the first or second clip. A support system for supporting a facade on a wall structure includes at least two dual-sided mounting brackets and support member.

19 Claims, 3 Drawing Sheets

(56) References Cited

U.S. PATENT DOCUMENTS

| | | | | |
|---|---|---|---|---|
| 5,740,646 | A * | 4/1998 | Wirkus | E04G 21/1875 52/307 |
| 6,612,087 | B2 * | 9/2003 | diGirolamo | E04B 9/008 52/712 |
| 6,792,733 | B2 * | 9/2004 | Wheeler | E04B 2/7457 52/656.1 |
| 7,665,701 | B2 | 2/2010 | Mitterbacher et al. | |
| 8,555,592 | B2 * | 10/2013 | Daudet | E04B 2/768 52/489.1 |
| 8,839,575 | B1 | 9/2014 | Liu et al. | |
| 9,663,948 | B2 * | 5/2017 | Lehane | E04B 9/30 |
| 10,724,229 | B2 * | 7/2020 | Daudet | E04B 1/388 |
| 10,767,684 | B1 * | 9/2020 | Meine | F16B 37/14 |
| 10,961,704 | B2 * | 3/2021 | Daudet | E04B 2/789 |
| 11,515,831 | B2 * | 11/2022 | Affentranger, Jr. | F16J 15/14 |
| 11,555,307 | B2 * | 1/2023 | Viebahn | E04B 2/789 |
| 11,643,808 | B2 | 5/2023 | Osmanski | |
| 11,674,316 | B2 | 6/2023 | Osmanski et al. | |
| 12,158,008 | B2 * | 12/2024 | Ochi | E04F 13/0807 |
| 2001/0045075 | A1 * | 11/2001 | Watanabe | E04F 13/0826 52/715 |
| 2003/0150179 | A1 * | 8/2003 | Moreno | E04F 13/0808 52/235 |
| 2008/0078894 | A1 * | 4/2008 | Morrow | E04B 1/003 248/200 |
| 2011/0107710 | A1 * | 5/2011 | Sias | E04B 7/063 29/897.3 |
| 2019/0153727 | A1 * | 5/2019 | Stahl, Jr. | E04B 2/96 |
| 2021/0238861 | A1 | 8/2021 | Osmanski et al. | |
| 2023/0392385 | A1 * | 12/2023 | Mason | E04F 13/0805 |

OTHER PUBLICATIONS

Dur-O-Wal, Inc. "Technical Documentation for Adjustable Veneer Anchor System D/A/ 213" Technical Bulletin 85-11, 7 pages, accessed Mar. 26, 2025.

Nvelope Making Cladding Happen "Rainscreen Cladding Systems" catalogue, www.nvelope.com, 56 pages, 2013.

Hohmann & Barnard, Inc. "BL-407 Anchor" https://www.h-b.com/products/bl-407-anchor, accessed Mar. 26, 2025.

Hohmann & Barnard, Inc. "HB-213 Adjustable Veneer Anchor" https://www.h-b.com/products/hb-213-adjustable-veneer-anchor, accessed Mar. 26, 2025.

* cited by examiner

DUAL-SIDED MOUNTING BRACKET

CROSS-REFERENCE TO RELATED APPLICATION

This application claims the benefit of and priority to Provisional U.S. Patent Application Ser. No. 63/408,635, filed Sep. 21, 2022, titled, DUAL-SIDED MOUNTING BRACKET, the disclosure of which is incorporated herein in its entirety.

FIELD OF THE DISCLOSURE

The present disclosure relates to an improved mounting bracket, and more particularly, to a mounting bracket for a facade mounting system that temporarily secures a support member to either side of the bracket, and allows for mounting the support member to either side of the bracket.

BACKGROUND

Mounting brackets are used to, for example, mount a support system for a facade or rain screen to an underlying substrate such as a building backup wall. These brackets typically are L-shaped members and include a baseplate secured to the backup wall and an extension leg that extends outwardly from the baseplate. An elongated vertical mounting member is mounted to the mounting bracket. The vertical member can be an elongated L-shaped extrusion having a first leg that is mounted to the extension leg and a transverse leg. The transverse leg is parallel to the backup wall. U.S. Pat. No. 7,665,701 discloses one a mounting bracket and is incorporated by reference herein in entirety.

In a typical installation, multiple vertical members are mounted to a series of vertically arrayed mounting brackets. Horizontal members are then mounted to the vertical members to form a matrix-like support system to which a facade, such as a rain screen is mounted. In many installations, insulation is disposed between the backup wall and the facade. Patent Application Publication No. WO2018/036756, entitled "Device for Securing Facade Parts" discloses an example and is incorporated by reference in entirety.

It is important to maintain the facade planar relative to the backup wall. As such the distance between the transverse leg and the backup wall must be allowed to vary, as by moving the vertical members toward and away from the backup wall before the vertical members are affixed in place. The ability to move the vertical member allows for accounting for variations in the backup wall.

Further, the facade should be positioned and installed so as to prevent water incursion into the space occupied by the insulation. And, for aesthetics as well as performance, the facade should be flush and plumb, and each panel of the facade planar with each other facade panel. One challenge to installation is temporarily securing the vertical member to the bracket while attempting to plumb the vertical member and to assure that the vertical member is planar with the adjacent/other vertical members.

Moreover, while certain systems permit temporarily securing the vertical members, the vertical member can only be secured to one side of the bracket which can result in a difficult installation when for example, a right-handed installer must secure the vertical member to the left side of the bracket or a left-handed installer must secure the vertical member to the right side of the bracket, or when installing a vertical member in a tight location.

Accordingly, there is a need for a dual-sided mounting bracket for a facade mounting system that temporarily secures an associated member, such as a vertical member to the bracket, and allows for securing and affixing the associated member to either side of the bracket.

SUMMARY

Various embodiments of the present disclosure provide a dual-sided mounting bracket for a facade mounting system. The bracket temporarily secures an associated member, such as a vertical member to the bracket, and allows for securing and subsequently affixing the vertical member to either side of the bracket.

In an aspect, a dual-sided mounting bracket includes an L-shaped member having a baseplate for securing to the wall structure and a transverse leg extending from and transverse to the baseplate. The transverse leg defines an inside surface, an outside surface, and a plane.

The transverse leg has first and second clips formed therein on opposing sides of a height centerline. The first clip extends in a first direction from the transverse leg plane and the second clip extends in a second, opposite direction from the transverse leg plane. Each the first and second clips define an angled opening at free ends thereof and a capture region adjacent to the angled openings. The first and second clips are configured to receive the vertical member in either the first or second; that is, on either side of the transverse leg.

In embodiments, each clip includes first, second and third bends. The first bend is at a juncture of the clip with the leg body, and bends away from the plane of the leg. The second bend is spaced from the first bend and bends back toward the leg plane, and the third bend is spaced from the second bend and bends away from the leg plane. The third bend defines the angled opening. In an embodiment, the first bend is formed at an angle and the second bend is formed at an angle less than the first bend; the third bend is formed at an angle greater than the first and second bend angles.

In embodiments, the first and second clips are spaced from one another in a direction parallel to the plane of the transverse leg. In such embodiments, an intermediate portion of the transverse is disposed between the first and second clips. The intermediate portion can be in the transverse leg plane. The clips can be mirror images of one another.

In embodiments, the mounting bracket can further include ribs in the baseplate and/or the transverse leg. The ribs can be strengthening ribs.

In another aspect a dual-sided mounting bracket includes an L-shaped member having a baseplate for securing to the wall structure and a transverse leg extending from and transverse to the baseplate. The leg has first and second clips formed therein on opposing sides of a height centerline and extend in opposite directions from a plane of the transverse leg. The clips are configured to receive and secure a portion of a vertical support member therein.

In embodiments, the first and second clips each have an angled opening defining a receiving region at respective free ends thereof for receipt of the portion of the vertical support member in one of the first and second clips. The clips can further include capture regions adjacent their respective receiving openings.

The mounting bracket can include fastener receiving openings in the baseplate and the transverse leg.

In embodiments, each clip includes a first bend a second bend and a third bend, the third bend defining the receiving region.

In still another aspect, a support system for supporting a facade on a wall structure, which wall structure has a backup wall includes a dual-sided mounting bracket and a vertical member. The dual-sided mounting bracket is formed as an L-shaped member having a baseplate for securing to the wall structure and a leg extending from and transverse to the baseplate. The transverse leg has first and second clips formed therein on opposing sides of a height centerline and extending in opposite directions from a plane of the transverse leg. The support member has first and second legs in an L-shape. The support member first leg is positioned between the first or second clip and a planar portion of the transverse leg. The support system can further include a second dual-sided mounting bracket vertically aligned with the first dual-sided mounting bracket, such that the vertical member extends between and is secured to the first and second dual-sided mounting brackets. The support system may further include first and second dual-sided mounting brackets horizontally aligned an arranged to receive a leg of a horizontally-oriented support member.

An example of a dual-sided mounting bracket for a facade support system for supporting a facade on a wall structure includes a baseplate with an inside surface and an outside surface and configured to secure to the wall structure. A leg extends from and transverse to the baseplate. The leg has a height centerline and defines a plane extending in a length dimension and a height dimension. The leg includes a leg body connected to the baseplate at a junction, the leg body includes an inside surface and an outside surface and has a free end opposite the baseplate. A first clip extends proud in a first direction from the plane and offset to a first side of the height centerline. The first clip is configured to receive and resiliently support a support member between the first clip and the leg body. A second clip extends proud in a second direction from the plane and offset to a second side of the height centerline. The second clip includes a second angled opening at the free end of the body and the second slip is configured to receive and resiliently retain the support member between the second clip and the leg body.

The dual-sided mounting bracket may include a gasket layer secured to the outside surface of the baseplate. The baseplate may include at least one mounting hole through the baseplate and the gasket layer is secured to at least the outside surface of the baseplate and across the at least one mounting hole. The gasket layer may include a polymer. The gasket layer may be further secured to the inside surface of the baseplate. An intermediate finger is within the plane and centered on the height centerline between the first clip and the second clip. The dual-sided mounting bracket may include a first mounting hole through the leg body at the free end of the leg body at a position above the first and second clips in the height dimension, a second mounting hole through the leg body at the free end of the leg body at a position below the first and second clips in the height dimension, and a third mounting hole through the intermediate finger at the free end of the leg body. First and second ribs may extend proud of the baseplate inside surface and the leg inside surface. The first and second ribs terminate in the length dimension along the leg at or before a first bend of the first clip and the second clip. The first rib may be located at a position above, in the height dimension, the height centerline, the first clip, and the second clip and the second rib may be located at a position below, in the height dimension, the height centerline, the first clip, and the second clip.

Another example of a dual-sided mounting bracket for a facade support system for supporting a facade on a wall structure includes a baseplate. The wall structure may have a backup wall and the support system may include a support member. The baseplate includes an inside surface and an outside surface and is configured to secure to the wall structure. The baseplate extends in a width dimension from a free end to a connected end. A gasket layer is secured to the outside surface of the baseplate. A leg extends from and transverse to the baseplate and forms and L with the baseplate. The leg includes a height centerline and defines a plate extending in a length dimension and a height dimension. The leg includes a leg body connected to the connected end of the baseplate at a junction. The leg body has an inside surface and an outside surface and has a free end opposite the baseplate. A first clip extends proud in a first direction from the plane and is offset to a first side of the height centerline. The first clip includes a first angled opening at the free end of the body. The first clip is configured to receive and resiliently retain the support member between the first clip and the leg body. A second clip extends proud in a second direction from the plane and is offset to a second side of the height centerline. The second clip includes a second dangled opening ant the free end of the body. An intermediate finger is within the plane and is centered on the height centerline between the first clip and the second clip. First and second ribs extend product of the baseplate inside surface and the leg inside surface.

DETAILED DESCRIPTION

While the present disclosure is susceptible of embodiments in various forms, there is described presently preferred embodiments with the understanding that the present disclosure is to be considered an exemplification and is not intended to limit the disclosure to the specific embodiments illustrated.

Figure 1:
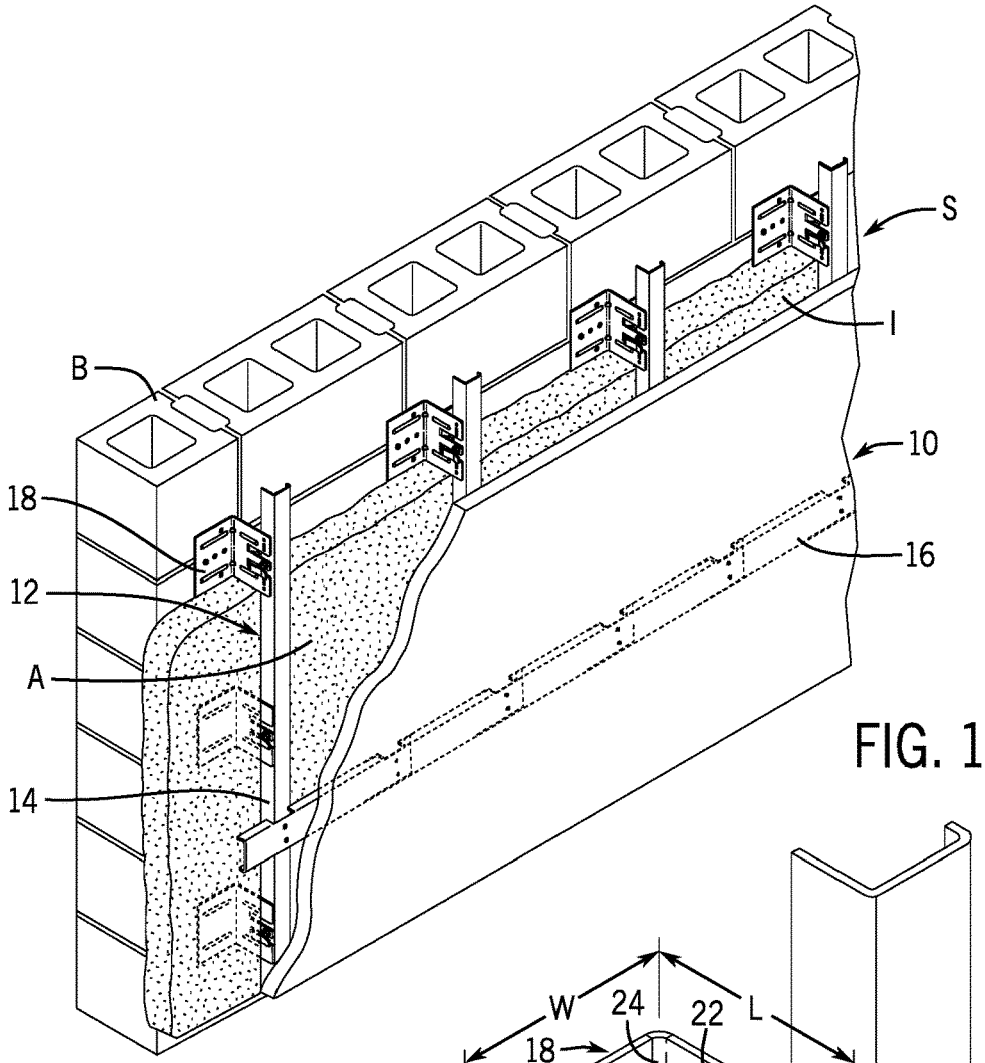
FIG. 1 is a perspective view of a wall structure showing a backup wall, insulation, a facade, and a facade support system having a dual-sided mounting bracket according to embodiments of the present disclosure, portions of the rainscreen and insulation shown broken away for ease of illustration.

Referring now to the figures and in particular to FIG. 1, there is shown a wall structure S that includes a backup wall B which, as illustrated is a block wall. Other backup wall structures S will be recognized by those skilled in the art. The wall structure S can further include insulation I, a facade 10, such as a rainscreen and a facade support system 12 in accordance with the present disclosure. Other elements may be present between the insulation I and the backup wall B and between the insulation I and the facade 10, such as condensation and waterproof barriers/films and the like. In addition, an air space A may be present between the insulation I and the facade 10. Other examples of facades, rain screens, and support systems are described in co-pending U.S. application Ser. Nos. 17/161,798 and 17/833,369 and U.S. Pat. Nos. 11,643,808 and 11,674,316, which are each incorporated by reference herein in their entireties and disclose features which may be combined with features disclosed herein to arrive at further combinations within the scope of the present disclosure.

As seen in FIG. 1, the facade support system 12 includes vertical support members 14 and/or horizontal support members 16. The vertical support members 14 are secured to the backup wall B or structure S by a series or plurality of dual-sided mounting brackets 18 according to embodiments disclosed herein. In an example, the horizontal support members 16 may be optionally secured to the vertical support members 14. In examples, the vertical support members 14 are typically 8-12 ft in length, although the presently disclosed mounting brackets may be used with shorter or longer lengths of vertical support members as well. The mounting brackets 18 are exemplarily arranged in a grid and the spacing between mounting brackets may depend upon the construction of the backup wall B or structure S or the facade 10. In one example, the mounting brackets 18 may be vertically spaced 24 inches and horizontally spaced 32 inches. In another example, the mounting brackets 18 may be vertically spaced 36 inches and horizontally spaced 16 inches. In still further examples, the mounting brackets 18 are oriented+/−90 degrees from the orientation shown and horizontal support member 16 are secured between the mounting brackets 18 as described herein.

Figure 2:
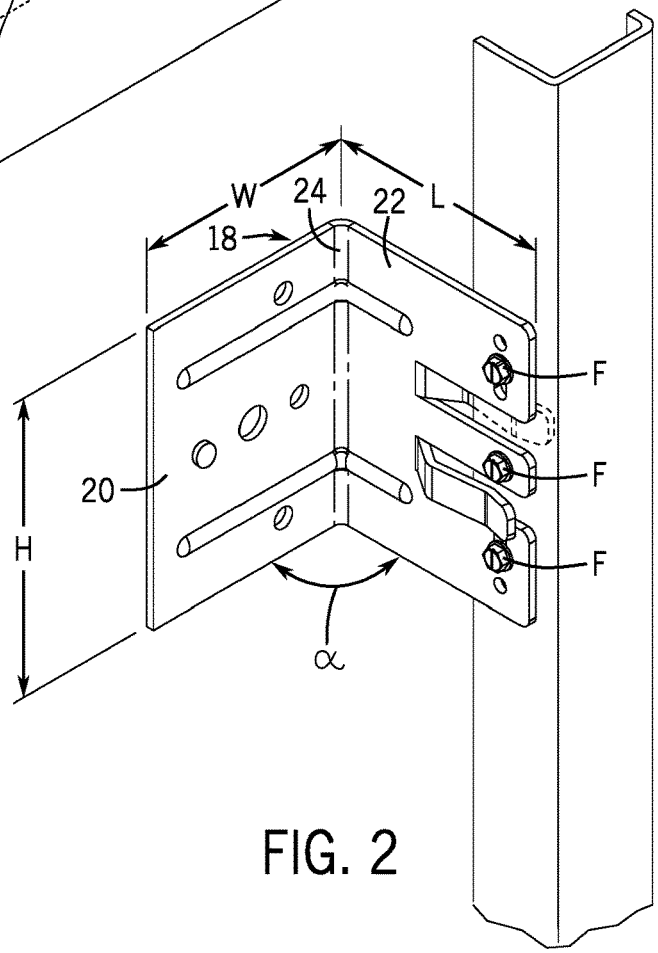
FIG. 2 is a perspective view of bracket and a support member, showing the support member engaged with the bracket.
Figure 4:
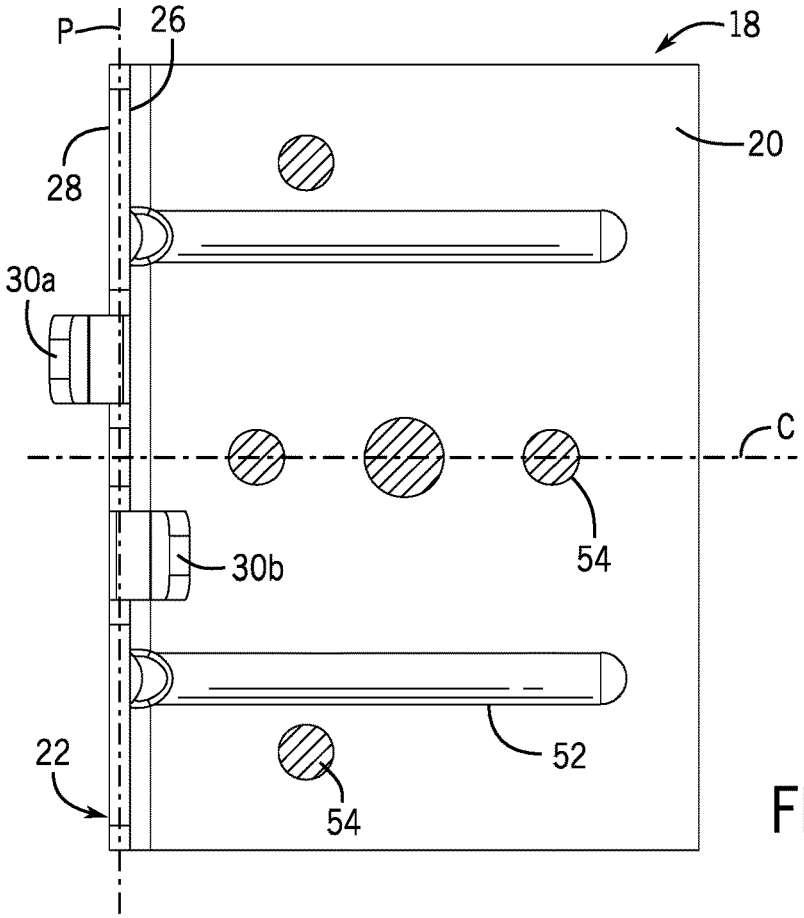
FIG. 4 is a front view of the bracket.
Figure 5:
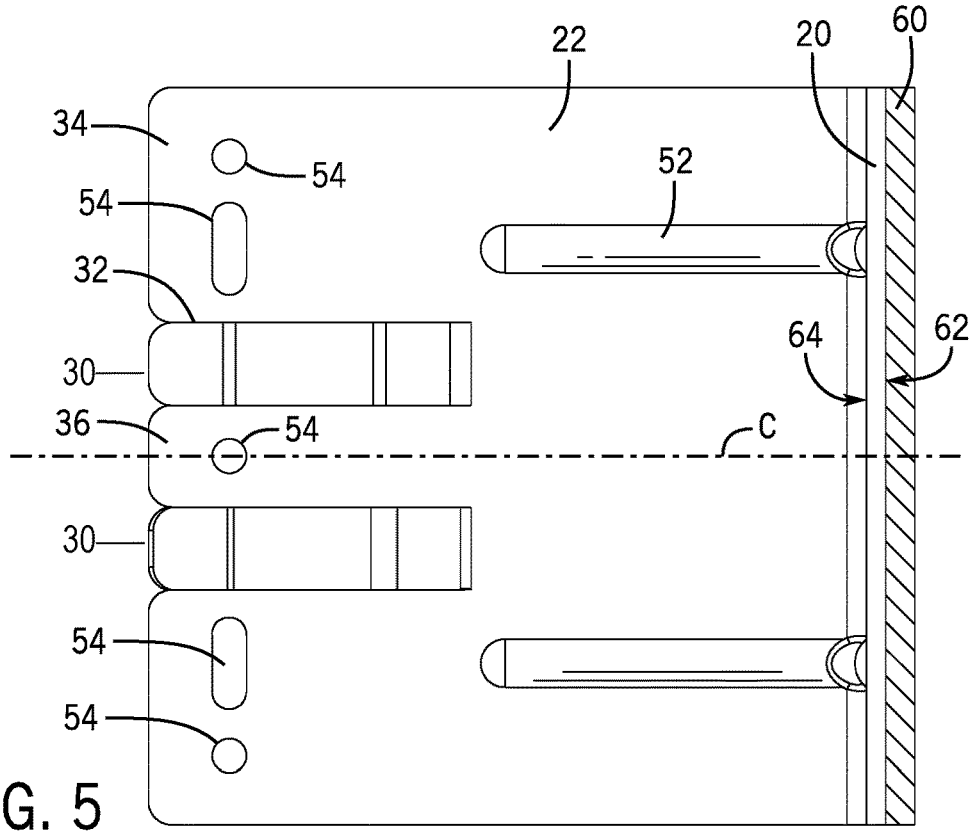
FIG. 5 is a side view of the bracket.

The mounting bracket 18 is depicted in further detail in FIGS. 2, 4, and 5, and is an L-shaped member that includes a baseplate 20 that is mounted to the backup wall B or structure S as described herein. The mounting bracket 18 includes a leg 22 that extends outwardly from, and transverse to, the baseplate 20 to define a juncture 24 between the baseplate 20 and leg 22. The leg 22 is formed of a leg body with an inside surface 26 within the interior angle $\alpha$ of the L-shape between the baseplate 20 and the leg 22 and an outside surface 28 opposite the inside surface and outside of the L-shape. The body of the leg 22 is connected to the baseplate 20 at the juncture 24. The mounting bracket 18 has a height H, a width W is defined primarily by the baseplate 20, and a length L is defined primarily by the leg 22. The body of the leg 22 further defines a plane P.

The mounting bracket 18 can include one or more strengthening ribs 52. The strengthening ribs may extend continuously from the baseplate 20 through the juncture 24 and along the leg 22. In another example, the strengthening ribs 52 may be provided as separate rib intervals on the baseplate 20, at the juncture 24, and on the leg 22. The strengthening ribs 52 extend proud into the interior of the L-shape formed between the baseplate 20 and the leg 22. As will be discussed in further detail herein, the strengthening ribs 52 may be constructed in a range of dimensions, however, in embodiments, the strengthening ribs 52 terminate in the length dimension along the leg 22 prior to the clips 30 as detailed herein. The strengthening ribs 52 are exemplarily constructed in a stamping process to form the ribs 52 from the material of the mounting bracket 18.

The mounting bracket 18 can also include one or more mounting holes 54 in the baseplate 20 to receive fasteners to secure the baseplate 20 to the backup wall B or wall structure S. A gasket layer 60 is provided on an outside surface 62 of baseplate 20 of the mounting bracket 18. The outside surface 62 is opposite an inside surface 64. The inside surface 64 of the baseplate 20 faces the L-shape between the baseplate 20 and the leg 22. The gasket layer 60 may be integrally constructed with the baseplate 20 or otherwise secured thereto. The gasket layer 60 is exemplarily of silicone or other polymer material. The gasket layer 60 may be applied as a liquid or flowable state and may be dried or cured to form an ambiently stable structure. If curing is used, such curing may exemplarily include, but is not limited to chemical, light, or heat curing. In other examples, the gasket layer 60 may be secured to the mounting bracket 18 with an adhesive. The gasket layer 60 may generally cover the width W and height H extent of the baseplate 20. While not depicted in FIG. 4, still further examples of the bracket have the gasket layer 60 extend across the inside surface 64 of the baseplate 20 as well. Further examples may additionally surround the edges of the baseplate with the gasket layer 60.

As shown in FIG. 4, the gasket layer 60 may further extend across the mounting holes 54. In use, the backup wall B or wall structure S may include components, features, or layers that provide thermal, air, and/or moisture barriers. In practice, fasteners used with mounting brackets, puncture such barriers when securing the mounting bracket 18 to the backup wall B or wall structure S. The gasket layer 60 as described herein, forms a seal about each of these punctures and has been found to mitigate the effect of these punctures, improving the resulting thermal, air, and/or moisture barrier in the final completed structure. Examples of the gasket layer 60 that extend across both the outside surface 62 and the inside surface 64 further provide the gasket layer across the mounting holes 54 and additional barrier between the baseplate 20, gasket layer 60, backup wall B or wall structure S.

The leg 22 includes a pair of clips 30A, 30B (collectively, 30) formed therein. The clips 30 are exemplarily formed by cuts 32 inwardly from a free end 34 into the body of the leg 22. In an example, the cuts 32 may be made with a die, although other machining and/or manufacturing processes will be recognized and are not limiting on the scope of the present disclosure. The clips 30 extend in opposite directions from the plane P of the leg 22. One clip (exemplarily 30A) extends proud of the outside surface 28 of the leg 22 and another clip (exemplarily 30B) extends proud of the inside surface 26 of the leg 22, as described in further detail herein. The clips 30 are vertically spaced apart in the height H dimension and thus define an intermediate finger 36 therebetween. The intermediate finger 36 is exemplarily centered on a height centerline C of the mounting bracket 18 and leg 22. The clips 30A, 30B are thus evenly spaced about the height centerline C. In an example, the intermediate finger 36 and the clips 30A, 30B are the same size in the height H and length L dimensions, although it will be recognized that the intermediate finger 36 may differ in dimension from the clips 30 in other examples.

Figure 3A:
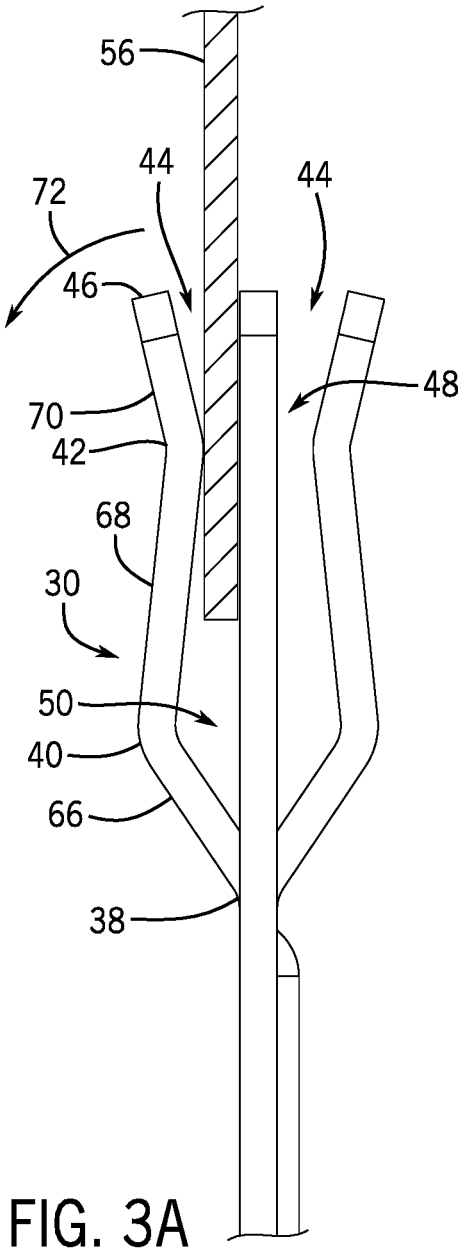
FIG. 3A is a top view of the bracket illustrating the bracket and support member.
Figure 3B:
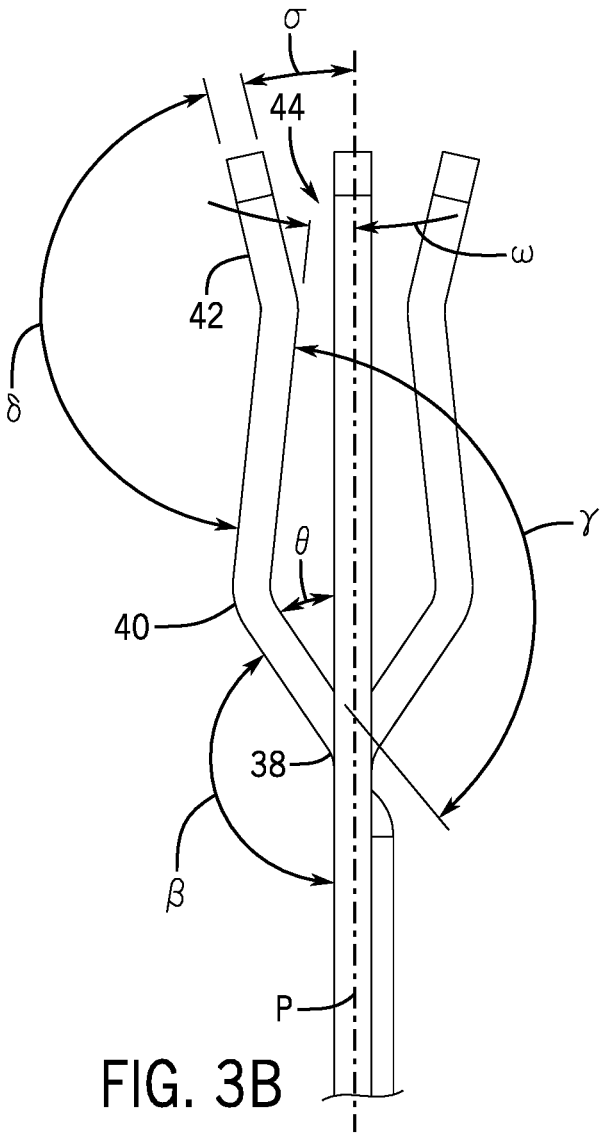
FIG. 3B is a top view of the bracket illustrating the bracket and clip angles.

Referring particularly to FIG. 3B, the clips 30 are exemplarily mirrored about the plane P. In an embodiment, each clip 30 include a first bend 38 away from the plane P and defining a first clip segment 66, a second bend 40 back towards the plane P and defining a second clip segment 68, and a third bend 42 away from the plane P and defining a third clip segment 70. The first bend 38 is formed at an obtuse supplemental angle $\beta$ exemplarily of 145 degrees. The second bend 40 is formed at an obtuse supplemental angle $\gamma$ exemplarily of 140 degrees. The angle $\gamma$ is exemplarily less than the angle $\beta$ of the first bend 38. The third bend 42 is formed at an obtuse supplemental angle $\delta$ exemplarily of 160 degrees. The angle $\delta$ is exemplarily greater than either of angles $\theta$ or $\gamma$. Each of these angles may exemplarily be +/−10 degrees, +/−5 degrees, +/−2 degrees, or other ranges from the values stated, while remaining within the scope of the present disclosure.

In reference to the plane P, the first bend 38 forms an acute supplemental angle θ, which is exemplarily 35 degrees, between the first clip segment 66 and the plane P. The second clip segment 68 forms angle σ relative to the plane P. The angle σ is exemplarily 5 degrees. The third clip segment 70 forms angle ω relative to the plane P. The angle ω is exemplarily 15 degrees. Each of these angles may exemplarily be +/−10 degrees, +/−5 degrees, +/−2 degrees, or other ranges from the values stated, while remaining within the scope of the present disclosure.

This configuration of bends 38, 40, 42 forms an angled opening 44 between an end 46 of the clip 30 and the plane P of the leg 22 at the angle co. The angled opening 44 necks down to a capture region 48 about the third bend 42, that then widens or opens, as seen at 50, to the second bend 40. Other angles and bend configurations will be recognized by those skilled in the art and are within the scope and spirit of the present disclosure.

The leg 22 includes one or more mounting holes 54 through which fasteners F are received to secure the support member 14, 16 to the leg 22. The mounting holes 54 in the leg 22 can be circular or elongated/notched or the leg 22 can include both circular and elongated/notched mounting holes 54. Elongated mounting holes, exemplarily provide a degree of movement between the support member 14, 16 and the mounting bracket 18 so as to accommodate variation due to thermal expansion. As previously described, the clips 30A, 30B define an intermediate finger 36 therebetween. The intermediate finger 36 includes a mounting hole 54 and is exemplarily centered on the height centerline C. The intermediate finger 36 thus provides a fastener mounting point to the support member 14, 16 at the height centerline C of the mounting bracket 18. This centered mounting point may provide an improved connection between the mounting bracket 18 and the support member 14, 16. In an example, three fasteners F may be used, one at the intermediate finger 36, one vertically above the clips 30 and one vertically below the clips 30.

A present mounting bracket 18 is formed from steel, such as stainless steel, such as type 304 stainless steel. Other suitable materials will be recognized by those skilled in the art. The mounting brackets 18 can be fabricated having a wide variety of sizes. The presently contemplated brackets 18 may have a non-limiting height H of about 4 inches and a non-limiting length L between 1-12 inches. The bracket 18 may have a non-limiting width of about 3-6 inches. Other mounting bracket 18 dimensions will be appreciated by those skilled in the art.

In use, a series of vertically aligned mounting brackets 18 will be secured to the backup wall B or structure S using fasteners F driven through the holes 54 in the baseplates 20 into the backup wall B or structure S. The gasket layer 60 provides a seal about the puncture caused by the fastener F driven into the backup wall B or structure S. An installer selects a side of the mounting bracket 18 in which the vertical member 14 is to be installed. It will be recognized that in applications, the vertical member 14 need not be secured to a same side of all of the mounting brackets 18. The mounting brackets 18 may be arranged rotated 180 degrees from one another, so long as the legs 22 and the respective clips 30 are in vertical alignment. This is a feature of the mounting bracket presently disclosed in that mounting brackets may be secured to the backup wall B or structure S in different orientations so as to accommodate positional obstructions (e.g. conduits, joints, mounting systems, etc.) while providing the mounting point to the vertical member, both for resilient connection to a clip 30 as well as fastening with one or more fasteners F.

The installer inserts a leg 56 of the vertical member 14 (the vertical members are typically angle or L-shaped members, for example as shown in FIGS. 1 and 2) into the angled opening 44 and to and into the capture region 48 to hold the vertical member 14 in the mounting brackets 18. The force of the leg 56 into the angled opening 44 spreads the clip 30, and particularly the clip 30 at the capture region 48 away from the plane P in the direction of arrow 72. The clip 30 is resilient against this deformation and places a corresponding spring force against the leg 56 and the leg 22. This resiliently, secures the vertical member 14 to the mounting bracket 18, while permitting sliding movement of the leg 56 relative to the mounting bracket 18. Once the vertical member 14 is plumb and in its final, proper position in the mounting brackets 18, fasteners F are driven through the legs' holes 54 and into the vertical member 14.

The present dual-sided mounting bracket 18 having clips 30A, 30B extending from the inside surface 26 and outside surface of the leg 22 provides extreme advantages over known mounting brackets. For example, because the mounting bracket 18 has clips on both sides of the leg 22, the vertical member 14 can be secured to either side of the leg 22. This makes installation considerably easier in that a right-handed individual can install the vertical member 14 on the left side of the mounting bracket 18 or a left-handed individual can install the vertical member 14 on the right side of the mounting bracket 18 and readily install a fastener F through the mounting bracket 18 and into the vertical member 14.

Further, the dual-sided mounting bracket 18 allows for installation in tight or difficult to reach and install locations, for example, corners and edges, in that a vertical member 14 can be installed to an inside surface 26 an outside surface 28 of the mounting bracket 18. As previously noted, while the description herein is made with reference to an example wherein the support members are arranged vertically (e.g. vertical support member 14). It is recognized and contemplated within the scope of the present disclosure that the dual-sided mounting brackets 18 described herein may be oriented +/−90 from the orientation shown in the figures to secure to a horizontally oriented support member (e.g. horizontal support member 16). In such an example, the mounting brackets 18 are secured to the backup wall B or the structure S with the leg 22 in a horizontal orientation. A leg of a horizontal support member 16 is resiliently received within a clip 30A, 30B to either side of the leg. The position of the horizontal support member 16 can be adjusted relative to the backup wall B or the structure S before fasteners F fixedly secure the horizontal support member 16 to the brackets 18.

In the present disclosure, the words "a" or "an" are to be taken to include both the singular and the plural. Conversely, any reference to plural items shall, where appropriate, include the singular. All percentages are percentages by weight, unless otherwise noted.

It will also be appreciated by those skilled in the art that the relative directional terms such as sides, upper, lower, top, bottom, rearward, forward and the like are for explanatory purposes only and are not intended to limit the scope of the disclosure.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dual-sided mounting bracket for a facade support system for supporting a facade on a wall structure, the support system including a support member, the mounting bracket comprising:

a baseplate comprising an inside surface and an outside surface and configured to secure to the wall structure; and a leg extending from and transverse to the baseplate, the leg having a height centerline and defining a plane extending in a length dimension and a height dimension, wherein the leg comprises:

a leg body connected to the baseplate at a junction, the leg body having an inside surface and an outside surface and having a free end opposite the baseplate;

a first clip extending proud in a first direction from the plane and offset to a first side of the height centerline, the first clip defining a first angled opening between the plane and an end of the first clip, wherein the first clip is configured to receive and resiliently retain the support member between the first clip and the leg body;

a second clip extending proud in a second direction from the plane and offset to a second side of the height centerline, the second clip defining a second angled opening between the plane and an end of the second clip, wherein the second clip is configured to receive and resiliently retain the support member between the second clip and the leg body; and an intermediate finger within the plane and centered on the height centerline between the first clip and the second clip.

2. The dual-sided mounting bracket of claim 1, further comprising a gasket layer secured to the outside surface of the baseplate.

3. The dual-sided mounting bracket of claim 2, wherein the baseplate comprises at least one mounting hole through the baseplate and the gasket layer is secured to the outside surface and across the at least one mounting hole, the gasket layer comprising a polymer.

4. The dual-sided mounting bracket of claim 1, further comprising:

a first mounting hole through the leg body at the free end of the leg body at a position above the first and second clips in the height dimension;

a second mounting hole through the leg body at the free end of the leg body at a position below the first and second clips in the height dimension; and a third mounting hole through the intermediate finger at the free end of the leg body;

wherein the mounting bracket is configured to be secured to the support member with fasteners through each of the first, second, and third mounting holes.

5. The dual-sided mounting bracket of claim 1, further comprising first and second ribs extending proud of the inside surface of the baseplate and the inside surface of the leg body.

6. The dual-sided mounting bracket of claim 5, wherein the first rib extends continuously across a first portion of the baseplate, the junction, and a first portion of the leg, and the second rib extends continuously across a second portion of the baseplate, the junction, and a second portion of the leg.

7. The dual-sided mounting bracket of claim 6, wherein first and second ribs terminate in the length dimension along the leg at or before a first bend of the first clip and the second clip.

8. The dual-sided mounting bracket of claim 5, wherein the first rib is located at a position above, in the height dimension, the height centerline, the first clip, and the second clip and the second rib is located at a position below, in the height dimension, the height centerline, the first clip, and the second clip.

9. A dual-sided mounting bracket for a facade support system for supporting a facade on a wall structure, the support system including a support member, the mounting bracket comprising:

a baseplate comprising an inside surface and an outside surface and configured to secure to the wall structure; and a leg extending from and transverse to the baseplate, the leg having a height centerline and defining a plane extending in a length dimension and a height dimension, wherein the leg comprises:

a leg body connected to the baseplate at a junction, the leg body having an inside surface and an outside surface and having a free end opposite the baseplate;

a first clip extending proud in a first direction from the plane and offset to a first side of the height centerline, the first clip defining a first angled opening between the plane and an end of the first clip, wherein the first clip is configured to receive and resiliently retain the support member between the first clip and the leg body; and a second clip extending proud in a second direction from the plane and offset to a second side of the height centerline, the second clip defining a second angled opening between the plane and an end of the second clip, wherein the second clip is configured to receive and resiliently retain the support member between the second clip and the leg body;

wherein the first and second clips each include a first bend between the clip and the leg body, the first bend away from the plane, a second bend spaced from the first bend along the clip, the second bend toward the plane, and a third bend spaced from the second bend along the clip, the third bend away from the plane.

10. The dual-sided mounting bracket of claim 9, wherein the third bends respectively define the first and second angled openings.

11. The dual-sided mounting bracket of claim 10, wherein a first clip segment is defined between the first bend and the second bend, a second clip segment is defined between the second bend and the third bend, and a third clip segment is defined from the third bend to the free end.

12. The dual-sided mounting bracket of claim 11, wherein the first bend is an acute angle away from the plane, the second bend forms an obtuse angle between the first clip segment and the second clip segment and the second clip segment forms an acute angle towards the plane, and the third bend forms an obtuse angle between the second clip segment and the third clip segment and forms an acute angle away from the plane.

13. The dual-sided mounting bracket of claim 12, wherein the acute angle formed by the third clip segment away from the plane is greater than the acute angle of the second clip segment towards the plane and less than the acute angle of the first clip segment away from the plane.

14. A dual-sided mounting bracket for a facade support system for supporting a facade on a wall structure, the support system including a support member, the mounting bracket comprising:

a baseplate comprising an inside surface and an outside surface and configured to secure to the wall structure, the baseplate extending in a width dimension from a free end to a connected end;

a gasket layer secured to the outside surface of the baseplate;

a leg extending from and transverse to the baseplate, and forming an L with the baseplate, the leg having a height centerline and defining a plane extending in a length dimension and a height dimension, wherein the leg comprises:

a leg body connected to the connected end of the baseplate at a junction, the leg body having an inside surface and an outside surface and having a free end opposite the baseplate;

a first clip extending proud in a first direction from the plane and offset to a first side of the height centerline, the first clip defining a first angled opening between the plane and an end of the first clip, wherein the first clip is configured to receive and resiliently retain the support member between the first clip and the leg body;

a second clip extending proud in a second direction from the plane and offset to a second side of the height centerline, the second clip defining a second angled opening between the plane and an end of the second clip; and an intermediate finger within the plane and centered on the height centerline between the first clip and the second clip; and first and second ribs extending proud of the inside surface of the baseplate and the inside surface of the leg body.

15. The dual-sided mounting bracket of claim 14, wherein the baseplate comprises at least one mounting hole through the baseplate and the gasket layer is secured to at least the outside surface of the baseplate and across the at least one mounting hole, the gasket layer comprising a polymer.

16. The dual-sided mounting bracket of claim 14, further comprising:

a first mounting hole through the leg body at the free end of the leg body at a position above the first and second clips in the height dimension;

a second mounting hole through the leg body at the free end of the leg body at a position below the first and second clips in the height dimension; and a third mounting hole through the intermediate finger at the free end of the leg body;

wherein the mounting bracket is configured to be secured to the member with fasteners through each of the first, second, and third mounting holes.

17. The dual-sided mounting bracket of claim 14, wherein the first rib extends continuously across a first portion of the baseplate, the junction, and a first portion of the leg, and the second rib extends continuously across a second portion of the baseplate, the junction, and a second portion of the leg;

wherein first and second ribs terminate in the length dimension along the leg at or before a first bend of the first clip and the second clip; and wherein the first rib is located at a position above, in the height dimension, the height centerline, the first clip, and the second clip and the second rib is located at a position below, in the height dimension, the height centerline, the first clip, and the second clip.

18. A support system for a facade on a wall structure, the support system comprising:

a dual-sided mounting bracket formed as an L-shaped member and comprising:

a baseplate comprising an inside surface and an outside surface and configured to secure to the wall structure, the baseplate extending in a width dimension from a free end to a connected end;

a gasket layer secured to the outside surface of the baseplate;

a leg extending from and transverse to the baseplate, and forming an L with the baseplate, the leg having a height centerline and defining a plane extending in a length dimension and a height dimension, wherein the leg comprises:

a leg body connected to the connected end of the baseplate at a junction, the leg body having an inside surface and an outside surface and having a free end opposite the baseplate;

a first clip extending proud in a first direction from the plane and offset to a first side of the height centerline, the first clip defining a first angled opening between the plane and an end of the first clip;

a second clip extending proud in a second direction from the plane and offset to a second side of the height centerline, the second clip defining a second angled opening between the plane and an end of the second clip; and an intermediate finger within the plane and centered on the height centerline between the first clip and the second clip; and first and second ribs extending proud of the inside surface of the baseplate and the inside surface of the leg body; and a support member having first and second legs in an L-shape;

wherein the first leg of the support member first leg is positioned between the first or second clip and a planar portion of the transverse leg.

19. The dual-sided mounting bracket of claim 18, further comprising:

a first mounting hole through the leg body at the free end of the leg body at a position above the first and second clips in the height dimension;

a second mounting hole through the leg body at the free end of the leg body at a position below the first and second clips in the height dimension; and a third mounting hole through the intermediate finger at the free end of the leg body;

wherein the mounting bracket is configured to be secured to the support member with fasteners through each of the first, second, and third mounting holes.

* * * * *